US008807195B2

(12) United States Patent
Coenraets

(10) Patent No.: US 8,807,195 B2
(45) Date of Patent: Aug. 19, 2014

(54) DEVICE WITH WINDABLE CURTAIN

(75) Inventor: Benoit Coenraets, Brussels (BE)

(73) Assignee: Dynaco Europe NV, Moorsel-Aalst (BE)

( * ) Notice: Subject to any disclaimer, the term of this patent is extended or adjusted under 35 U.S.C. 154(b) by 760 days.

(21) Appl. No.: 12/526,220

(22) PCT Filed: Jan. 31, 2008

(86) PCT No.: PCT/EP2008/051204

§ 371 (c)(1),
(2), (4) Date: May 5, 2010

(87) PCT Pub. No.: WO2008/101780

PCT Pub. Date: Aug. 28, 2008

(65) Prior Publication Data

US 2010/0288452 A1 Nov. 18, 2010

(30) Foreign Application Priority Data

Feb. 7, 2007 (EP) ..... 07101852

(51) Int. Cl.

| | |
|---|---|
| ***A47G 5/02*** | (2006.01) |
| ***E06B 9/56*** | (2006.01) |
| ***A47H 3/00*** | (2006.01) |
| ***E06B 9/17*** | (2006.01) |
| ***E06B 9/58*** | (2006.01) |
| ***E06B 9/13*** | (2006.01) |
| *E06B 9/171* | (2006.01) |

(52) U.S. Cl.

CPC ..... *E06B 9/13* (2013.01); *E06B 2009/1716* (2013.01); *E06B 9/581* (2013.01)

USPC ..... 160/273.1; 160/271; 160/270; 160/268.1

(58) Field of Classification Search

USPC ..... 160/264, 273.1, 266, 267.1, 271, 310, 160/268.1

See application file for complete search history.

(56) References Cited

U.S. PATENT DOCUMENTS

| | | | | |
|---|---|---|---|---|
| 5,547,009 | A * | 8/1996 | Plumer | 160/310 |
| 2006/0037718 | A1* | 2/2006 | Coenraets | 160/133 |
| 2007/0277943 | A1* | 12/2007 | Boerger et al. | 160/273.1 |
| 2008/0035282 | A1* | 2/2008 | Coenraets | 160/272 |

FOREIGN PATENT DOCUMENTS

| | | | |
|---|---|---|---|
| DE | 19636176 | A1 | 3/1998 |
| EP | 1460231 | A2 | 9/2004 |
| WO | 03048497 | A1 | 6/2003 |

* cited by examiner

*Primary Examiner* — Katherine Mitchell
*Assistant Examiner* — Jeremy Ramsey
(74) *Attorney, Agent, or Firm* — Browdy and Neimark, PLLC

(57) ABSTRACT

The invention concerns a device with a curtain which can be rolled up and unrolled between a shut position and an open position, whereby this curtain (1) comprises a belt (2,3) on each of its faces, whereby each belt (2,3) has successive teeth (5,6) in the longitudinal direction, whereby these belts (2,3) are situated opposite one another in such a way that they can mesh when the curtain (1) is being rolled up. At least one of these belts (2,3) comprises teeth (5,6) having at least one recess (8,9) in which at least one protruding part (10,11) of the teeth (5,6) of the other belt (2,3) can engage in such a way that the two belts (2,3) can mesh and such that one of these belts (2,3) can push the other belt (2,3) in their longitudinal directions.

7 Claims, 3 Drawing Sheets

DEVICE WITH WINDABLE CURTAIN

The present invention concerns a curtain with flexible lateral edges, which can be rolled up and unrolled between a shut and an open position.

It concerns a curtain which comprises a belt on each of the faces near the lateral edges, whereby these two belts with teeth are situated in such a manner in relation to each other that they can mesh when the curtain is being rolled up.

It is important that, when the curtain is unrolled, one can exert a sufficiently large force on it in a direction which is parallel to the lateral edges. For certain applications, one must be able to exert a pushing force on the lateral edges of the curtain in their longitudinal direction when the curtain is being rolled up.

Also, one of the main aims of the present invention is to provide a very efficient solution to this problem, also for curtains that must be moved at very high speeds.

To this end, according to the invention, at least one of these belts comprises teeth having at least one recess in which at least a part of the teeth of the other belt can engage in such a manner that the two belts can mesh, and such that one of the belts can push the other belt in the longitudinal direction so as to move the curtain when it is unrolled from its open position into its shut position or when it is rolled up.

According to a preferred embodiment of the invention, the two above-mentioned belts are serrated and have teeth in the shape of saw teeth.

According to an interesting embodiment of the invention, the two above-mentioned belts are serrated and have teeth in the form of clamps.

Further details and particularities of the invention will become clear from the following description, given by way of example only without being limitative in any way, of several particular embodiments of a device with a roller curtain according to the invention, with reference to the accompanying drawings.

Figure 6:
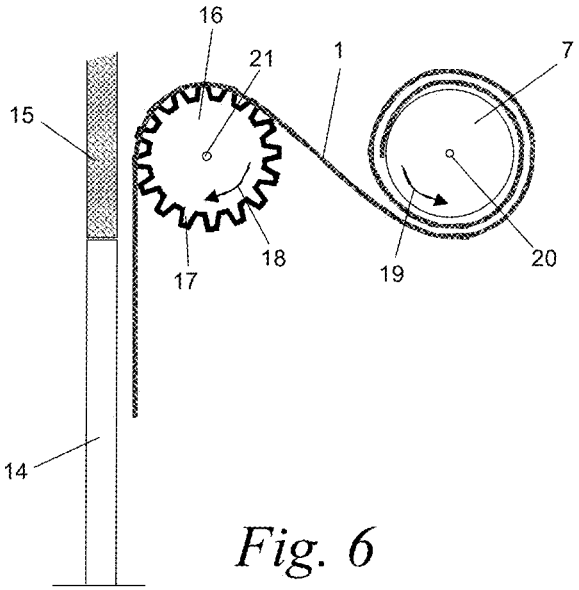

FIG. 6 very schematically represents a transversal section of a first application of the device with a curtain according to the invention, mounted in front of a window opening.

Figure 7:
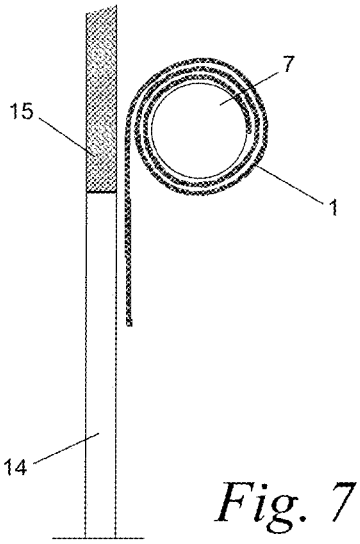

FIG. 7 very schematically represents a transversal section of a second application of the device with a curtain according to the invention, mounted in front of a bay.

In the different drawings, the same figures of reference refer to analogous or identical elements.

In a general manner, the invention concerns a device with a roller curtain designed to shut a bay or any other opening whatsoever, such as a door or window bay, the loading space of a vehicle, such as a lorry or a vessel, to cover a swimming pool, etc.

The above-mentioned curtain has lateral edges which are preferably made of a flexible material. This curtain may be formed for example of a tarpaulin, a netting, a succession of lamellas that are linked to one another and that extend at right angles to their direction of movement, laterally edged by a supple zone provided with serrated belts, etc.

This device is characterised in that at least one of these belts comprises teeth having at least one recess in which at least a part of the teeth of the other belt can engage in such a way that both belts can mesh, and such that one of these belts can push the other belt in the longitudinal direction so as to move the curtain when it is unrolled from its open position into its shut position. During this unrolling, the belts do not become unhooked in the rolled-up part of the curtain, such that the successive windings of this rolled-up part stay closely fit to one another. The belts only unhook there where the curtain goes from its rolled-up state into its unrolled state.

Figure 1:
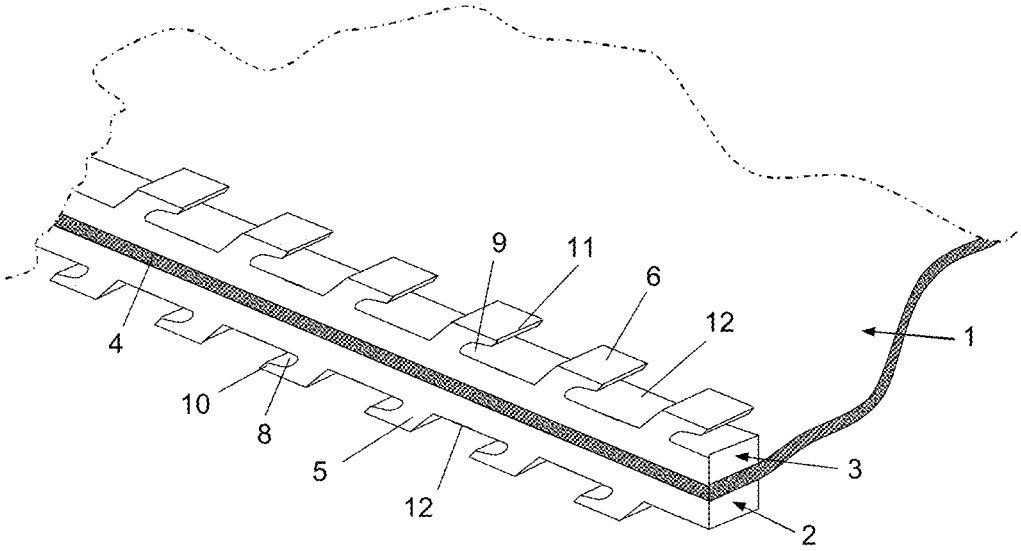
FIG. 1 shows a view in perspective of a part of the lateral edge of the curtain of a device according to a first embodiment of the invention.
Figure 2:
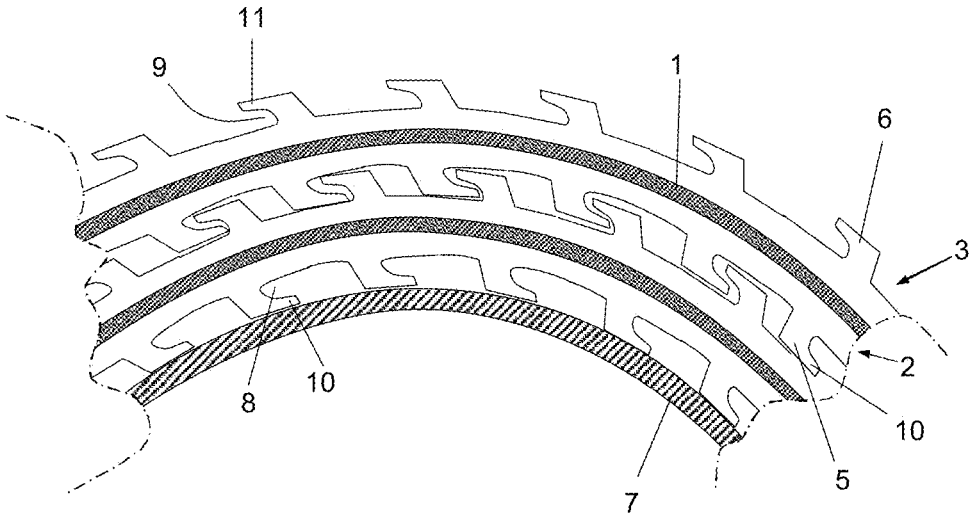
FIG. 2 shows a longitudinal section of a part of the curtain of said first embodiment in a rolled-up position.

FIGS. 1 and 2 concern a first embodiment of the device according to the invention.

In this embodiment is represented a part of a curtain 1 having a serrated belt 2 and 3 fixed to each of its faces. These belts 2 and 3 are situated on the lateral edge 4 of the curtain 1 facing each other in such a way that they can mesh when the curtain 1 is being rolled up, as represented in FIG. 2 where the curtain 1 is rolled up on a drum 7. The drum 7 is preferably formed of a cylinder whose width corresponds to the width of the curtain 1.

In this embodiment, the teeth 5 and 6 of said belts 2 and 3 look like clamps.

Thus, these teeth 5 and 6 have a recess 8, 9 respectively, and a protruding part 10, 11 respectively. The protruding parts 10 and 11 of the teeth 5 and 6 hang over the corresponding recesses 8 and 9 of said teeth in the longitudinal direction of the belts 2 and 3.

The shape of these recesses 8, 9 and of the protruding parts 10, 11 is such that the protruding part 10 of the teeth 5 of one of the belts 2 can mesh and hook in the recess 9 of the teeth 6 of the other belt 3, and vice-versa when the curtain 1 is rolled up. The teeth 5 and 6 preferably have an identical shape, whereas the protruding part of the teeth 5 is directed in a sense opposite to that of the teeth 6. This is also true for the distance between two consecutive teeth 5, adjusted to the one between the teeth 6, namely the notches 12 provided between these teeth.

Figure 3:
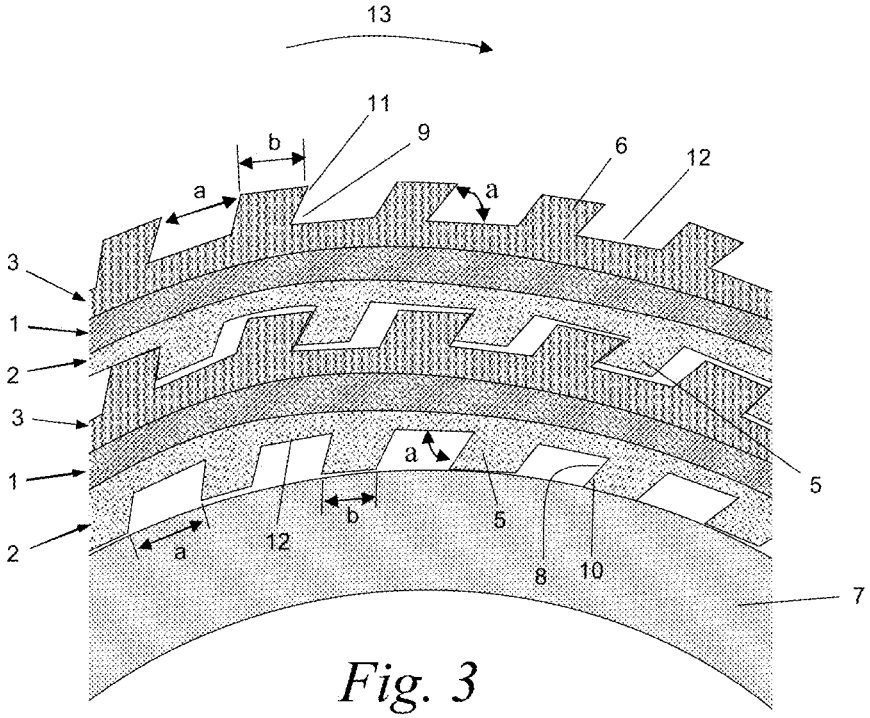
FIG. 3 shows a longitudinal section at the height of the belts of a rolled-up part of a curtain according to a second particular embodiment of the invention.

FIG. 3 represents a second embodiment which differs from the one in FIGS. 1 and 2 by the shape of the teeth.

Indeed, in FIG. 3, the teeth 5 and 6, separated by notches 12, have a section in the longitudinal direction of the belts 2 and 3 with a trapezoidal shape.

In this way, these teeth have a transversal face which is inclined at an acute angle (a) and they also form clamps having substantially the same function as in the first embodiment. The acute angle (a) is preferably situated between 10° and 40°, and advantageously it is in the order of 20°. More specifically, in FIG. 3, the teeth 5 and 6 in particular have a section in the longitudinal direction of the belts 2 and 3 having the shape of a parallelogram.

The acute angle (a) is particularly selected such that the far ends of the protruding parts 10 and 11 of a belt 2 cannot rub the protruding parts of the other belt 3 when the curtain 1 is rolled up or unrolled. Thus, the protruding parts 10 and 11 of the teeth 5 and 6 cannot be deformed or damaged there where the unrolled part of the curtain 1 makes contact with the rolled-up part of the latter.

The inclination of the teeth 5 of the belt 2 is opposite to the one of the teeth 6 of the belt 3 so as to allow the teeth of the belt 3 to rest on the teeth 5 of the belt 2 when the shutter is being unrolled, as indicated by the arrow 13.

The width 'a' of the notches 12, in the longitudinal direction of the belts 2 and 3, is superior to the corresponding width 'b' of the teeth 5 and 6.

This is advantageous in that particles, such as dust, cannot accumulate in said notches 12 and hinder the meshing of the teeth 5 and 6. In particular, thanks to a free space between said notches 12 between the teeth 5 and 6, such dust particles are automatically removed from the notches 12 when the belts 2 and 3 mesh.

In a first variant of the device according to the invention, which is not represented, the teeth have a symmetrical plane which is perpendicular to the longitudinal sense of the belts, such that a recess and a protruding part are provided on the opposite sides of the teeth in a longitudinal direction.

Thus is obtained a double catching between the teeth of the one belt and those of the other belt.

Figure 5:
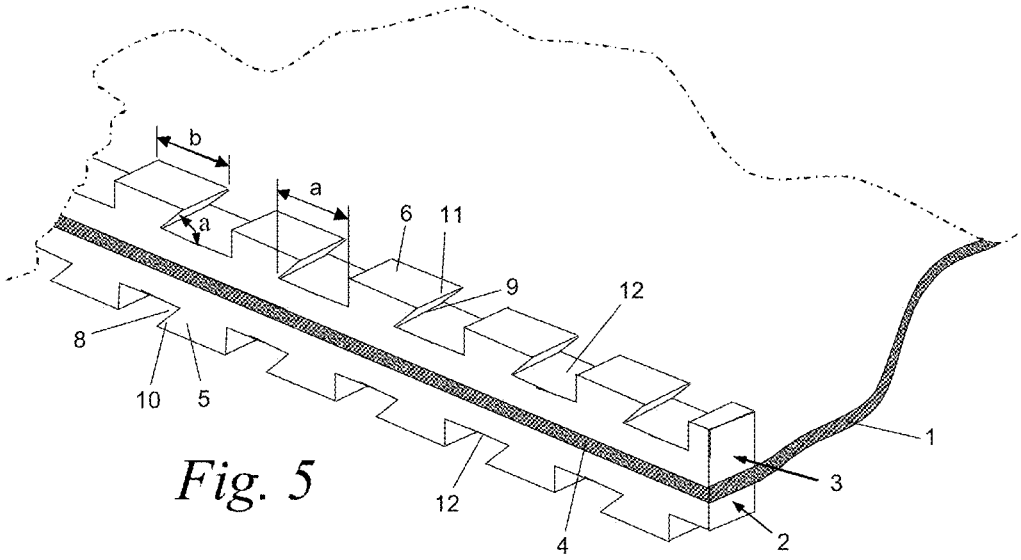
FIG. 5 shows a view in perspective, analogous to that in FIG. 4, of a part of the lateral edge of a curtain according to a variant of the device according to the invention.

In another variant of the device according to the invention as represented in FIG. 5, the width 'a' of the notches 12 at the base of the latter and in the longitudinal direction of the belts 2 and 3 corresponds substantially to the corresponding width 'b' of the teeth 5 and 6. Thus is obtained a catching of the teeth 5 and 6 in the corresponding notches 12 which is relatively solid in comparison with the preceding embodiments, given that these teeth 5 and 6 are clamped in the latter when the curtain is rolled up.

The teeth 5 and 6 of the belts 2 and 3 have a lateral face which extends substantially perpendicular to the longitudinal direction of the belts and an opposite face which is inclined at an acute angle (a), for example in the order of 20°, in relation to said direction. Consequently, the teeth 5 and 6 have a section with a trapezoidal shape in the longitudinal direction of the belts 2 and 3.

FIG. 6 represents a first, very interesting application of the device with a curtain according to the invention. In this application, the device with a curtain is mounted opposite a bay 14 provided in a wall 15.

The device works in conjunction with a driving drum 16 which is formed of a cylinder whose width corresponds substantially to the width of the curtain 1 and whose far ends are provided with a succession of teeth 17 extending along the perimeter.

Opposite this driving drum 16 is mounted a rolling drum 7, such that the driving drum 16 is situated between the bay 14 or the wall 15 and the drum 7.

As represented in FIG. 6, the curtain 1 extends opposite the bay 14 and it is then guided over part of the perimeter of the driving drum 16. As of this driving drum 16, the curtain 1 moves towards the drum 7 round which it is enrolled so as to bring it into its open position.

Figure 4:
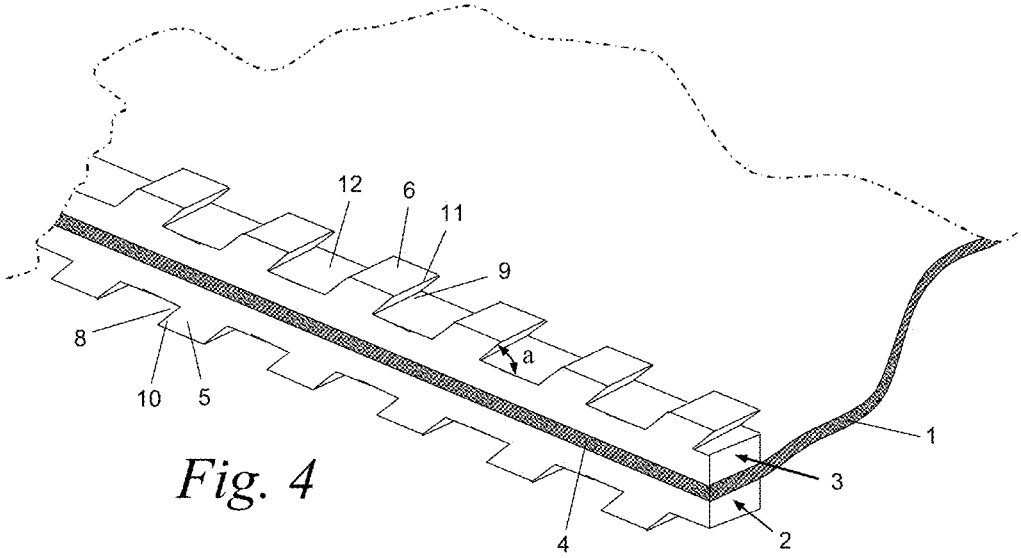
FIG. 4 shows a view in perspective of a part of a lateral edge of the curtain from FIG. 3.

The lateral edges of the curtain 1 are, for example, provided with serrated belts 2 and 3, as represented in FIG. 4, and they work in conjunction with the teeth 17 of the driving drum 16. In particular, the teeth 5 of the belt 2 which is directed towards the driving drum 16 mesh with the teeth 17 of said drum 16. Thus, when the driving drum 16 is set in motion, for example by a motor which is not represented in FIG. 6, the curtain 1 moves into its open position or its shut position.

For clarity's sake, the belts 2 and 3 are not represented in FIG. 6, which is a schematic representation.

When the curtain 1 moves into its open position, the drum 16 is driven in the direction of the arrow 18, such that a pushing force is exerted on the lateral edges of the curtain 1, in particular on the belt 2 in the longitudinal direction. Thus, the rolling drum 7, which can turn freely round its central axis 20, is being driven is well, such that the curtain 1 is rolled up on said drum 7.

As the teeth of the two belts 2 and 3, provided with both sides of the curtain 1, mesh, the successive windings of the part of the curtain 1 which is rolled up on the rolling drum 7 will fit closely and form a compact roll. This makes it possible for the rolling drum 7 to be driven round its axis by the mere action of the pushing force which is exerted by the lateral edges of the curtain 1.

FIG. 7 represents a second application of the device with a curtain according to the invention. This device comprises a rolling drum 7 which is driven round its axis by a motor which is not represented. The drum 7 is mounted opposite a wall 15 above a bay 14, such that the latter can be shut by unrolling the curtain 1.

The curtain 1 is provided with belts on its lateral edges, as represented for example in FIG. 1 or in FIG. 4.

Thus, the successive windings of the roll, formed by the part of the curtain 1 which is rolled up on the drum 7, are fit closely to one another by the meshing of the teeth 5 and 6 of the corresponding belts 2 and 3.

When the curtain 1 is unrolled into its shut position, the successive windings stay closely fit to one another until the curtain 1 is disengaged from the roll and moves more or less vertically opposite the wall 15 and the bay 14.

This is particularly important when the lateral edges of the curtain 1 are guided by sliding rails provided on either side of the bay 14. In this case, a pushing force is exerted by the drum 7 on the lateral edges of the curtain in the longitudinal direction of the latter, which makes it possible to overcome the frictional forces in the sliding rails. It is clear that, when the successive windings of the roll do not fit closely to one another, this is not possible.

Just as in FIG. 6, the belts 2 and 3 are not represented in FIG. 7 either.

It is clear that the present invention is not limited to the different embodiments described above, some of which are represented in the accompanying drawings, but that also many other variants are possible while still remaining within the scope of the invention.

Thus, the shape of the teeth, in particular of the means to make the teeth of one belt mesh with those of another one may vary within large limits.

The invention claimed is:

1. A device with a curtain which can be rolled up and unrolled between a shut position and an open position, said curtain (1) having lateral edges and a first and a second face opposite to each other, the curtain comprising a belt (2,3) with a longitudinal direction on each of its faces, wherein each belt (2,3) has successive teeth (5,6) extending along said longitudinal direction, said belts (2,3) being situated opposite one another in such a way that they can mesh when the curtain (1) is being rolled up, wherein at least one of these belts (2,3) comprises teeth (5,6) having at least one recess (8,9) forming an undercut in which at least one protruding part (10,11) of the teeth (5,6) of the other belt (2,3) can engage in such a way that the two belts (2,3) can mesh and such that one of these belts (2,3) can push the other belt (2,3) in a longitudinal direction, wherein said protruding part (10,11) of each tooth (5,6) hangs over the recess (8,9) forming said undercut defined by said protruding part of said each tooth in the longitudinal direction of the belts (2, 3).

2. The device according to claim 1, wherein the belts (2,3) are serrated and have teeth (5,6), separated by notches (12), wherein said teeth have a section in the longitudinal direction of the belts (2,3) with a trapezoidal shape, in particular the shape of a parallelogram.

3. The device according to claim 1, wherein the teeth (5,6) have a transversal face which is inclined at an acute angle ($\alpha$) in relation to the longitudinal direction of the belts (2,3) and in relation to a plane defined by the curtain (1) in a shut position of the curtain, and the inclination of said face of the teeth (5) of a belt (2) fixed to a first face of the curtain (1) is opposed to the inclination of the face of the teeth (6) of the belt (3) which is fixed to a second face of the curtain, in such a way that the teeth (5, 6) of one of the belts (2, 3) can rest on the teeth of the other belt when the curtain (1) is being unrolled or rolled up.

4. The device according to claim 1, wherein the teeth (5,6) have a symmetrical plane perpendicular to the longitudinal direction of the belts (2,3).

5. The device according to claim 1, wherein the teeth (5,6) of the belts (2,3) extend one after the other in the longitudinal direction of the belts.

6. The device according to claim 1, wherein the belts (2,3) extend parallel in relation to lateral edges of the curtain (1).

7. The device according to claim 1, further comprising a rolling drum (7) which can turn freely round its axis (20), and a driving drum (16) whose axis (21) extends substantially parallel to the axis (20) of the rolling drum (7), wherein the driving drum (16) has successive teeth (17) along its perimeter which can work in conjunction with the teeth (5,6) of one of the belts (2,3) so as to unroll the curtain (1) of the rolling drum (7) so as to move it into its shut position and so as to roll it up on the rolling drum (7) when the curtain (1) is being opened.

* * * * *